United States Patent [19]

Harvey

[11] 4,224,068

[45] Sep. 23, 1980

[54] METHOD OF MAKING DISTRIBUTOR ROTOR ELECTRODE CONTAINING DIELECTRIC BODIES FOR SUPPRESSING RADIO FREQUENCY INTERFERENCE

[75] Inventor: Douglas J. Harvey, Sterling Heights, Mich.

[73] Assignee: General Motors Corporation, Detroit, Mich.

[21] Appl. No.: 942,460

[22] Filed: Sep. 14, 1978

[51] Int. Cl.[3] ..... B22F 5/00

[52] U.S. Cl. ..... 75/206; 75/212; 75/213; 252/512; 123/633; 200/24

[58] Field of Search ..... 123/148 P; 200/24; 75/206, 212, 213; 252/512

[56] References Cited

U.S. PATENT DOCUMENTS

| | | | |
|---|---|---|---|
| 3,085,876 | 4/1963 | Alexander et al. | 75/206 |
| 3,730,706 | 5/1973 | Buescher et al. | 75/206 |
| 3,802,892 | 4/1974 | Pirooz | 106/52 |
| 4,072,771 | 2/1978 | Grier | 252/512 |
| 4,077,378 | 3/1978 | Okumura | 123/148 P |
| 4,130,671 | 12/1978 | Nagesh et al. | 252/512 |
| 4,135,066 | 1/1979 | Yamanaka et al. | 123/148 P |

*Primary Examiner*—Brooks H. Hunt

*Attorney, Agent, or Firm*—Elizabeth F. Goldberg

[57] ABSTRACT

This invention relates to an improved method of making a distributor rotor electrode wherein dielectric particles are dispersed in an electrically conductive metal matrix for suppressing radio frequency intereference. More particularly, the invention relates to a method of making such electrodes wherein a mixture comprised of silica and copper oxide is fused into a solid material which is then comminuted into powder particles 50 microns in size, or less, and having irregular shapes. The powder particles themselves are comprised of a microscopic interspersion of a silica based phase and a copper oxide based phase. These powder particles are thereafter combined with a powder of an electrically conductive metal to form a uniform second mixture comprising about 0.5 to 15 weight percent silica. The second mixture is then pressed in a compact for a rotor electrode body and sintered to form a wear resistant densified rotor electrode.

2 Claims, 7 Drawing Figures

METHOD OF MAKING DISTRIBUTOR ROTOR ELECTRODE CONTAINING DIELECTRIC BODIES FOR SUPPRESSING RADIO FREQUENCY INTERFERENCE

BACKGROUND OF THE INVENTION

This invention relates to a method of making improved, long wearing ignition distributor rotor electrodes. More particularly, the invention relates to a method of making rotor electrodes wherein specially adapted dielectric silica based particles are securely locked into the electrically conductive metal matrix of a rotor electrode body to suppress radio frequency interference.

Radio frequency interference (RFI) in vehicles powered by spark ignition internal combustion engines is caused, for the most part, by high voltage spark discharges across the rotor gap. The RFI source is a large, fast rise time impulsive current generated at the onset of the rotor gap breakdown. The higher the voltage required to break down the gap, the higher the intensity of the radio frequency interference noise. It is known that the breakdown voltage across a given rotor gap can be lowered by providing a source of initiatory electrons, e.g., a dielectric material, at the surface of the rotor electrode at the gap. It is theorized that these electrons are accelerated away from the electrode tip by the application of an electric field to collide with air molecules in the gap and ionize them. The presence of these ions increases the probability that the rotor gap will break down at a lowered voltage where RFI is substantially suppressed.

Certain prior art RFI suppressing distributor rotor electrodes have been made by mixing dielectric silica or glass particles with metal powder, compacting the powder mixture in the shape of the electrode, and sintering the compact to obtain a strong, dense electrode. A difficulty with such methods has been that the dielectric particles have necessarily been in the form of symmetrical small spherical powder particles or short fibers. They end up in the electrode in the same configuration and they are not strongly locked in the metal matrix. Although such electrodes suppress RFI noise generation, sparking at the rotor gap can dislodge the regularly shaped dielectric particles and cause excessive electrode wear and noise in the FM frequency band.

Accordingly, it is an object of my invention to provide a method of making a distributor rotor electrode wherein extremely small and irregularly shaped dielectric particles (basically silica) are formed in a conductive metal matrix. As a result, the dielectric particles are better locked in the metal matrix and reduce electrode wear and dielectric particle loss at the rotor gap.

It is a more specific object of my invention to provide a method of making a conductive metal distributor rotor electrode containing a distributed ultrafinely divided dielectric silica constituent. In such method the silica constituent is formed so that its shape is highly irregular and it is incorporated in the metal matrix so that it is tightly locked in. Copper is intimately associated with the silica, the copper being in its elemental or oxide form.

BRIEF SUMMARY OF THE INVENTION

In accordance with my invention these and other objects are accomplished as follows. A suitable mixture of copper oxide and silica is heated to a molten mass so that the copper and silicon oxides are uniformly mixed. Upon cooling, a friable material forms, but intimately mixed, with separate copper oxide and silica phases. The material is comminuted to a very fine powder, suitably no greater than 50 microns in largest dimension and preferably about one to ten microns. The individual particles are jagged and irregular in shape.

This oxide powder is thoroughly mixed with copper powder (or other suitable conductive metal powder) in proportions such that the silica content of the total mixture is in the range of about 0.5% to 15% by weight. The powder mixture is then compacted into the shape of a desired rotor electrode and sintered at a suitable elevated temperature in a reducing atmosphere (with respect to copper oxide) to form a dense, wear resistant rotor segment. It is believed that during sintering at least a portion of the copper oxide initially present is reduced to elemental copper. To the extent that copper oxide is not reduced, it is still closely associated with the silica constituent of the rotor and is believed to assist in suppressing radio frequency interference.

In accordance with my method the initial proportions of the copper oxide and silica are not understood to be critical so long as enough silica is present to obtain about 0.5% to 15% by weight in the finished distributor electrode. However, I prefer to form a silica-copper oxide mixture which is predominantly silica and contains only about 5% to 30% by weight cuprous oxide. Further, as is shown below, small amounts of other suitable oxides such as alumina may advantageously be added to the silica.

The invention will be more fully appreciated and clearly understood from a detailed description which follows. Reference will be made to the drawings in which.

Figure 5:
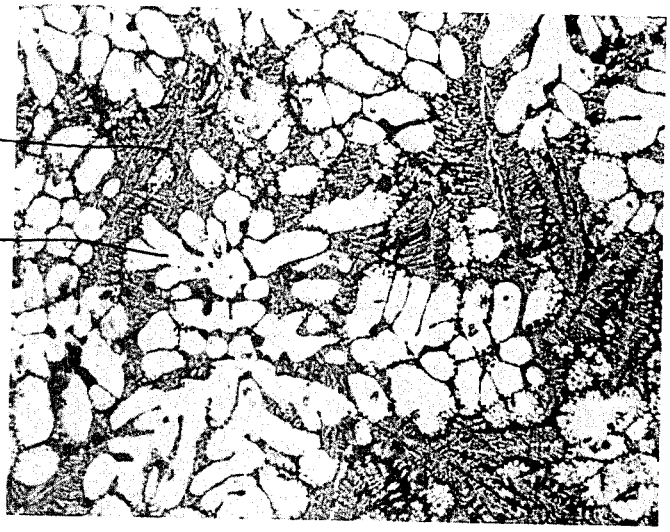
FIG. 5 is a photomicrograph of a copper oxide-silica glassy material like that of FIG. 4 after reduction of the copper oxide to copper showing the spongelike silica based microphase.
Figure 6:
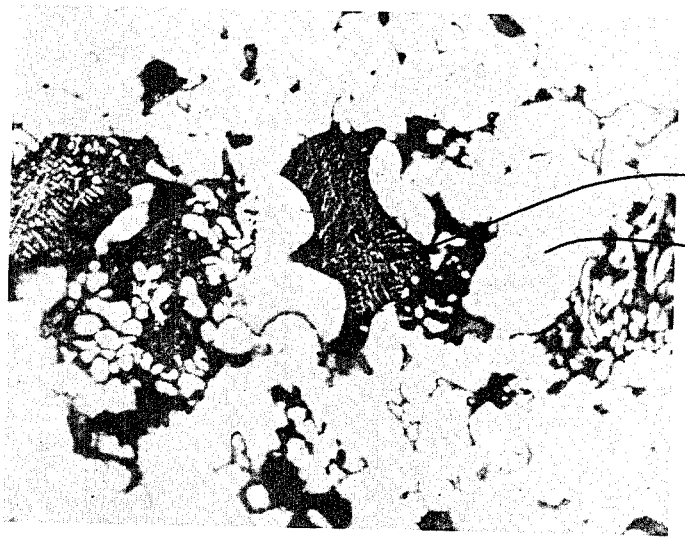
Figure 7:
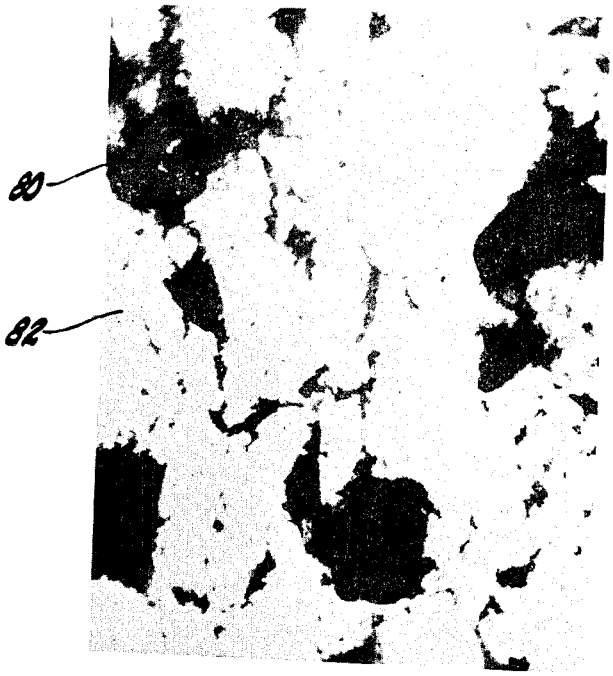

FIG. 6 is a photomicrograph at 500× magnification of a section of a sintered copper rotor electrode wherein reduced copper-silica particles, like those shown in FIG. 5, have been dispersed; and FIG. 7 is a photomicrograph at 500× magnification of a section of a copper rotor electrode, sintered in a reducing atmosphere, wherein the micron-sized dispersed copper-silica particles contain a major portion of silica (in weight parts 80 silica; 20 copper oxide).

Figure 1:
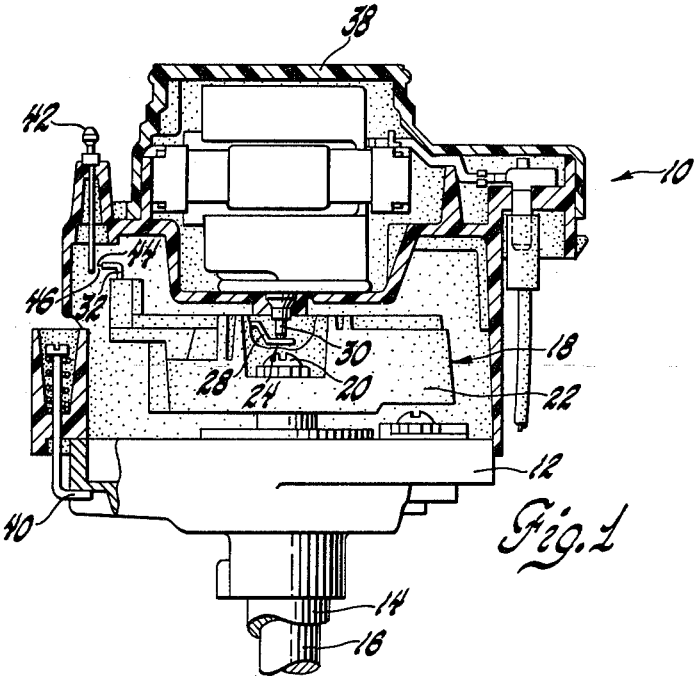
FIG. 1 is an elevational view, partly broken away and in section, of an ignition distributor for an internal combustion engine containing a rotor electrode made according to the invention. The electrode is shown in spark gap relation to a stationary spark plug cable electrode.

In a preferred embodiment and referring to FIG. 1, a view of a typical automobile ignition distributor 10 is shown. A distributor housing 12 is mounted on a stationary rotor shaft casing 14. Confined within casing 14 is rotor driving shaft 16 which is generally gear coupled with the engine cam shaft. A rotor 18 is mounted by screws 20 on driving shaft 16 to rotate therewith. Rotor 18 of distributor 10 comprises an insulating base 22, generally molded from an electrically nonconductive thermoplastic molding material, and a two-part conductive rotor electrode 24 mounted thereon (best seen at FIG. 2). Electrode 24 extends radially outward from rotational center 26 of rotor 18 to slightly beyond the outside perimeter of base 22. In the illustrated embodiment of the invention, the radially inward portion 28 of electrode 24 is a flat stainless steel strip which is slightly bent to bias against protruding secondary coil high tension electrode 30, assuring electrical contact therebetween. As clearly seen at FIG. 3, the radially outward portion 32 of electrode 24 is clamped against radially inward portion 28 by tab 34. An electrical connection is formed between the two electrode portions at interface 36. The radially outward electrode portion 32 is made according to the invention to contain microscopic irregularly shaped dielectric bodies in a fused metal phase. Obviously, other rotor and rotor electrode designs would be equally suited to the practice of the invention.

Referring to the cut-away section of FIG. 1, an ignition distributor cap 38 is mounted on distributor rotor housing 12 by means of spring loaded clips 40. A plurality of high tension spark plug cable lead terminals 42 are mounted in cap 38 in a circular pattern. During operation, a spark plug is electrically connected to each spark plug cable terminal 42 by a suitable connector cable (not shown). The terminals are positioned in cap 38 so they successfully come into spark gap relation with rotor electrode 24 driven by shaft 16. The space between the outward end 44 of electrode 24 when it is substantially radially aligned with a spark plug cable lead 42, is referred to as the rotor gap 46. A high energy ignition spark generated across gap 46 induces a high voltage in the associated spark plug cable and fires the connected plug.

Figure 2:
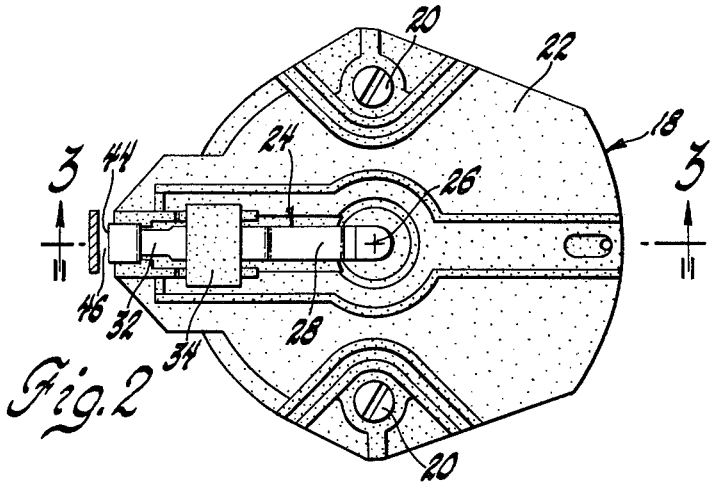
FIG. 2 is a plan view of the distributor rotor of FIG. 1.
Figure 3:
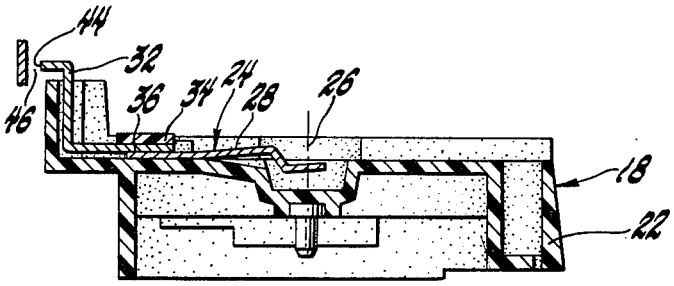
FIG. 3 is a sectional view of the rotor of FIG. 2 taken along line 3—3 looking in the direction of the arrows.

The operation of a distributor such as that shown in FIGS. 1 to 3 as it pertains to the practice of the invention can be briefly described as follows. As rotor 18 is turned by driving shaft 16, an electrical signal produced by suitable means passes therethrough to ground. The spark plugs are successively fired by interrupting the current flow to ground at about the time rotor electrode 24 is lined up directly with a spark plug cable lead terminal 42. This induces a high voltage in the secondary coil (not shown) and coil electrode 30. Current flows from the coil through rotor electrode 24 until the voltage becomes high enough to electrically break down gap 46. The spark generated across gap 46 causes a high tension current to flow through the associated spark plug cable to fire the connected plug.

The invention provides a method of making improved rotor electrodes by incorporating a novel type of silica-based noise suppressing particle. I have discovered that contaminating silica with copper oxide by fusing the materials together produces a friable material that may be crushed to form irregularly shaped micron-sized particles. These particles, when sintered with electrically conductive metal, preferably copper, yield rotor electrodes wherein the noise suppressing constituent particles are so firmly bonded that their service lives are greatly extended beyond those of single microphase, regularly shaped silica particles. The invention may be more fully comprehended in view of the following examples.

EXAMPLE I

One hundred parts by weight cuprous oxide ($Cu_2O$) were combined with 10 parts by weight silicon oxide ($SiO_2$) and 5 parts by weight aluminum oxide ($Al_2O_3$). The mixture was heated in an Inconel® crucible to about 1,060° C. where it melted. The melting point of the glass is substantially lower than the melting points of the constituents: silica, m.p. 1710° C.; cuprous oxide, m.p. 1210° C.; or alumina, m.p. 2030° C. The heating was continued to a temperature of about 1150° C. and the mixture was maintained thereat for about one hour. It was then poured into a second Inconel® crucible wherein it quickly cooled and solidified into a two-phase substantially non-crystalline material, the cuprous oxide comprising one phase, and the alumina and silica the other. Although this has been found to be a good method of cooling molten mixtures of constituents, the two-phase glasses have also been made by cooling a molten mixture in air in the melting crucible, slow cooling a mixture in the furnace, or simply pouring a mixture onto a slab of cold metal or concrete.

Figure 4:
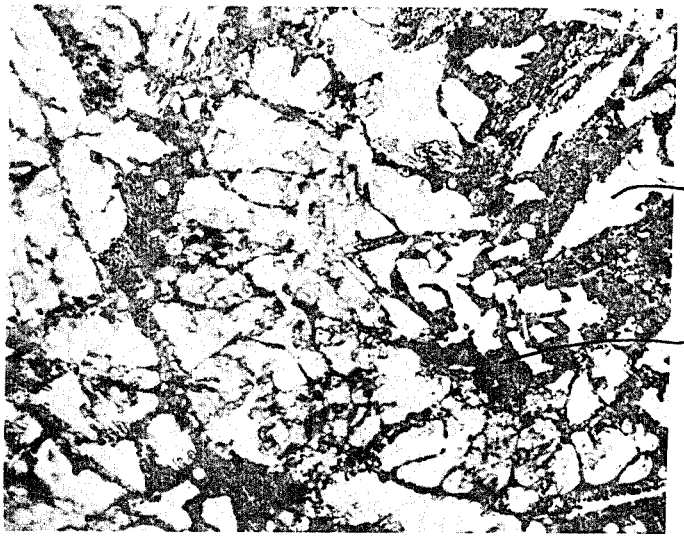
FIG. 4 is a photomicrograph at 500× magnification of a copper oxide-silica glassy material (in weight parts 100 copper oxide; 10 silica; 5 alumina) before reduction.

FIG. 4 is a photomicrograph at 500× magnification of the 85:10:5; $Cu_2O$:$SiO_2$:$Al_2O_3$ glass. The light colored areas 50 represent a cuprous oxide phase, while the darker regions 52 represent a silica and alumina phase.

Such two phase materials have also been formed from cuprous oxide and up to 20 weight percent silica without alumina. Although glassy materials from mixtures of silica and other dielectric oxides have not actually been made, there is no reason to believe that oxides of other elements such as magnesium, gadolinium, zirconium, or titanium, e.g., would not be equally useful. Similarly, cuprous oxide has been employed as the reducible metal oxide for making rotor electrodes because it is relatively inexpensive and copper is a good electrical conductor. However, it is believed that the oxides of other conductive metals such as silver, iron, nickel or cobalt would perform as well. A factor that must be taken into consideration in choosing a "dielectric oxide"-"reducible oxide" mixture is that the dielectric oxide must be more difficult to chemically reduce than the oxide of the electrically conducting base metal.

After cooling, the above-described glass was crushed into relatively fine particles to speed up the subsequent reduction process. The crushed particles were retained in a furnace at a temperature of about 700° C. for 30 minutes. The furnace atmosphere comprised Nitroneal® gas (95% nitrogen-5% hydrogen), the hydrogen therein acting selectively as a reducing agent for the cuprous oxide at furnace temperatures. The dielectric constituents, alumina and silica, being more difficult to reduce, were unaffected by the hydrogen atmosphere. It will be appreciated that other reducing atmospheres would also be suitable for the practice of the invention.

After the particles were removed from the furnace and cooled, they were subjected to electron probe analyses for the elements copper, silicon, aluminum and oxygen. The results showed that the alumina and silica were present in one phase and the copper in another. Herein such silica containing phase may be referred to simply as the silica glass phase. No oxygen was detected in the copper phase, indicating that substantially all the cuprous oxide had been reduced.

FIG. 5 is a photomicrograph of the reduced two-phase metal-silica glass composite material at 500× magnification. The light colored portions 60 represent the copper metal phase, and the dark portions 62 the silica-alumina glass phase. It is readily seen that the glass phase 62 forms a substantially continuous lacy or sponge-like matrix of glass bodies with the predominant copper metal phase filling the interslices. The particles themselves are generally not point symmetrical, i.e. irregularly shaped.

The relative weight percents and volume percents of each constituent of the above described reduced metal-glass composite material are given in Table I. Knowing the starting weight of each constituent oxide, in this case 100 pbw $Cu_2O$, 10 pbw $SiO_2$, and 5 pbw $Al_2O_3$, the percent amount of each constituent in the reduced metal-glass composite was calculated. The loss of oxygen from the reduction of the cuprous oxide, assuming all $Cu_2O$ was reduced to copper metal, was taken into account. The volume percent of each constituent was determined by dividing the weight percent of each constituent by its corresponding specific gravity (as given in the CRC Handbook of Chemistry and Physics) and normalizing to 100 total volume parts.

TABLE I

| Unreduced Glass | | Reduced Metal-Glass Composite | | | | |
|---|---|---|---|---|---|---|
| | pbw | | pbw | % weight | density | % volume |
| $Cu_2O$ | 100 | Cu | 88.8 | 85.6 | 8.92 | 66.1 |
| $SiO_2$ | 10 | $SiO_2$ | 10 | 9.6 | 2.65 | 25.0 |
| $Al_2O_3$ | 5 | $Al_2O_3$ | 5 | 4.8 | ~3.7 | 8.9 |

Rotor electrode segments were made by pressing the reduced metal-silica glass composite powder directly into a desired electrode shape and sintering. However, the compacts had insufficient green strength to allow for bulk handling and the sintered electrodes tended to be brittle. Thus, it is preferred to mix the metal-glass composite materials with an electrically conductive, malleable metal powder for pressing and sintering electrode shapes.

The two-phase composite powder described above was ground further, sieved, and the −200+325 mesh portion was retained. This powder was then mixed with −325 mesh atomized copper powder at the weight ratios of 20 parts reduced metal-glass composite to 80 parts copper; 10 parts reduced metal-glass composite to 90 parts copper; and 5 parts reduced metal-glass composite to 95 parts copper. Table II shows the relative weight percents and the volume percents of each constituent in these mixtures.

TABLE II

| Electrode Composition (pbw) | | | | | | | |
|---|---|---|---|---|---|---|---|
| Copper Powder | Copper-Glass Composite Powder | % weight | | | % volume | | |
| | | Cu* | $SiO_2$ | $Al_2O_3$ | Cu* | $SiO_2$ | $Al_2O_3$ |
| 80 | 20 | 97.11 | 1.92 | 0.96 | 91.7 | 6.1 | 2.2 |
| 90 | 10 | 98.56 | 0.96 | 0.48 | 95.8 | 3.1 | 1.1 |
| 95 | 5 | 99.28 | 0.48 | 0.24 | 97.9 | 1.6 | 0.5 |

*Total copper content of rotor electrode including contributions from copper powder and copper portion of composite powder.

The mixtures were compacted in a die having substantially the shape of the desired electrode, with allowance for shrinkage upon sintering, at pressures of about 275 to 425 megapascals (MPa). The compacts had good green strength and were easily handled. They were sintered for 30 minutes at 925° C. in a 95% nitrogen-5% hydrogen atmosphere. Sintering caused the copper powder to fuse with copper phase of the metal-glass composite powder thereby creating strong mechanical bonds between the minor portion of sponge shaped silica glass bodies and the fused metal. Where the reduced metal-silica composite material is comprised of a major phase or portion of metal and a minor phase of glassy silica, the above-mentioned fusion effect brought about by sintering is believed to provide particularly strong and spark erosion resistant rotor electrode materials. Hydrogen is a preferred sintering gas; however, any gaseous atmosphere which is unreactive with the constituents at sintering temperatures would be appropriate.

The sintered compacts were suitable for use as is on a distributor rotor without further processing. The sintered bodies were strong and ductile enough to be poured into storage bins, positioned by hand or machine in rotors, and, if necessary, bent into place on a rotor without breaking.

FIG. 6 is a photomicrograph at 500× magnification of a sintered rotor electrode formed as above. The dark portions 70 represent spongelike or lacy silica bodies. The light areas represent a fused copper matrix 72. It is the lacy shape of bodies 70 and the fusion of the copper in the interslices with the added copper powder that provides the subject electrodes with excellent resistance to erosion caused by sparking at a rotor gap.

Electrodes of each of the metal-glass composite and copper powder ratios, i.e., 20:80, 10:90, and 5:95, were tested in a high energy automobile ignition distributor such as that shown in FIG. 1. The distributor was mounted in bench service testing equipment which simulates distributor operation in an automobile ignition system under controlled conditions. A spindle, corresponding to the rotor driving shaft in an automobile, was set to rotate the rotor at 1,750 revolutions per minute (rpm) and the primary distributor coil was connected to a 12 V D.C. source. The distributor output terminals were shorted together and connected to ground through standard television and radio suppression (TVRS) spark plug cable. Testing was done with vacuum advance adjusted so that sparking occurred along the surface of the rotor electrode tip at the gap. The voltage at the rotor tip was monitored on an oscilloscope as a function of time. A Stoddart spiral cone antenna (No. 93490-1, 200-1,000 MHz) was placed in near field and interphased with a Hewlett Packard 8551-A Spectrum Analyzer to monitor the RFI noise at frequencies in the range of 0 to 1,000 MHz. The RFI noise output was measured on the spectrum analyzer in the range of from 0 to 40 decibels above one microvolt per meter per kilohertz (relative db). FM noise, caused chiefly by the presence of particles in the rotor gap, was subjectively determined by listening to an FM radio located within about B 15 feet of the rotor. One hour of bench testing in this apparatus is roughly equivalent to 100 miles normal service in an automobile.

Throughout testing, the breakdown voltage for each electrode was measured to be about 8 kV or less compared to breakdown voltages of the same gap with a plain copper rotor electrode of about 20 kV. The RFI output of each electrode was judged quiet as measured by the spectrum analyzer, generally averaging less than 10 relative db over the entire 1,000 MHz frequency range. A 20% reduced glass, 80% copper powder electrode was run for 625 hours (equivalent to about 62,500 in-car miles) without any substantial electrode wear, increase in AM noise or any audible FM noise. The experiment was stopped only to free the testing equipment, the spark wear being so minimal that the electrode could have stood up to much more service.

Another rotor electrode made as above and comprising a 20% reduced glass-80% copper mixture was placed in a late model eight-cylinder automobile equipped with a standard Delco ® high energy ignition distributor. The electrode was tested therein for radio frequency interference noise using SAE test procedure J-551c. Briefly, the test procedure entails measuring the horizontal and vertical components of the RFI field (in units of relative decibels) received by an antenna positioned ten meters from the right and left hand sides of a vehicle. Noise readings are taken at suitable intervals over the frequency range of 20–1,000 MHz at bandwidths not greater than 1 MHz. The highest relative db signal measured at a particular frequency is recorded, and may be checked against the "quiet" radiation operating limit proscribed by the test. The electrode suppressed RFI signal generation to a level well below the acceptable noise limit according to the SAE J-551c test across the entire frequency range.

EXAMPLE II

Eighty parts silica and 20 parts cuprous oxide were melted in air in a graphite crucible with a small arc welder using a carbon electrode. A material with two apparent microphases in the solid state, most probably a major silica phase and a minor copper oxide or copper phase, was formed. The material was allowed to cool in the crucible and was thereafter ground in a ball mill to a powder having irregularly shaped particles in the 1 to 50 micron size range. It has been found that electrode wear is adversely affected where much smaller or larger particles are used. Ten weight parts of the powder were combined with 80 weight parts −325 mesh atomized copper powder. The mixture was then compacted in a die having substantially the shape of the desired electrode with allowance for shrinkage upon sintering at a compacting pressure of about 241 MPa. The compact was sintered in a reducing hydrogen atmosphere for 30 minutes at about 800° C.

FIG. 7 is a photomicrograph at 500× magnification of a section of the rotor segment. The dark areas 80 represent the irregularly shaped two phase particles and the light areas fused copper powder. The sintering step in hydrogen is believed to cause the selective reduction of cuprous oxide to copper; however, as seen at FIG. 7, where silica comprises the major portion of the composite RFI suppressing material in the range of from about 95 to 70 weight percent of the total, the formation of the sponge-like dielectric body is not apparent and the copper powder most likely does not fuse directly with the reduced copper in the composite particles. Nevertheless, the highly irregular shape of the composite particles themselves provide excellent adhesion with the sintered copper matrix so that the rotor electrodes are strong, durable and resistant to spark erosion. I have found that the desired noise suppressing characteristics are achieved when the total silica content of the electrode material is in the range of from about 0.5 to 15 weight percent.

A rotor segment was bench tested in the apparatus described in Example I for 452 hours (the equivalent of about 45,200 in-car miles). Throughout the test, the RFI output was generally in the range of about 9–11 relative db over the pertinent 1,000 MHz frequency range. The electrode showed no substantial wear. Thereafter, it was placed in a late model eight cylinder automobile equipped with a standard Delco ® high energy ignition distributor. The electrode was subjected to the SAE J-551c test as described in Example I. The electrode was found to suppress RFI signal generation to levels well below the acceptable noise limits according to the SAE test at all frequencies between 20 and 1,000 MHz. No audible noise was detected in an FM radio placed in the near field.

Thus, I have provided a method of making improved, RFI suppressing rotor electrodes. I have discovered that contaminating silica by fusing it with copper oxide, grinding the friable product into micron sized irregularly shaped particles, and sintering the particles with additional metal powder in a reducing atmosphere produces rotor electrodes with excellent wear characteristics.

While the invention has been disclosed in terms of specific embodiments thereof, it will be appreciated that other forms could readily be adapted by one skilled in the art. Accordingly, the scope of the invention is to be considered limited only by the following claims.

The embodiments of the invention in which an exclusive property or privilege is claimed are defined as follows:

1. A method of making a spark erosion resistant distributor rotor electrode containing irregularly shaped dielectric particles dispersed in an electrically conductive metal matrix for suppressing radio frequency interference, said method comprising:

fusing a first mixture comprising silica and copper oxide to form a microscopic interspersion of said constituents in a friable solid material;

comminuting said material to a powder, the powder particles being characterized by their irregular shapes and an average particle size of 50 microns or less;

combining an amount of said powder with a powder of an electrically conductive metal or metals to form a uniform second mixture comprising from about 0.5 to 15 weight percent silica;

pressing said second mixture into a compact for a rotor electrode body; and sintering said compact in a reducing atmosphere to form a densified rotor electrode body.

2. A method of making an electrically conductive metal distributor rotor electrode in which spark erosion resistant dielectric particles are dispersed for suppressing radio frequency interference, the method comprising:

fusing a first mixture consisting essentially by weight of from about 5 to 30 percent copper oxide and the remainder silica to form a microscopic interspersion of said constituents in a friable solid material;

comminuting said material to a powder, the powder particles being characterized by their irregular shapes and an average particle size of 50 microns or less;

combining an amount of said powder with copper metal powder to form a uniform second mixture comprising from about 0.5 to 15 weight percent silica;

pressing said second mixture into a compact for a rotor electrode body; and sintering said compact in a reducing atmosphere for said copper oxide to form a densified rotor electrode body wherein at least a portion of the copper oxide of the irregularly shaped particles is reduced to copper metal.

* * * * *